United States Patent [19]

Bowers

[11] 4,246,721

[45] Jan. 27, 1981

[54] AERIAL TOY

[76] Inventor: Louis Bowers, 10600 N. 62nd St., Temple Terrace, Fla. 33617

[21] Appl. No.: 73,850

[22] Filed: Sep. 10, 1979

[51] Int. Cl.[3] ..... A63H 27/00

[52] U.S. Cl. ..... 46/79; 273/425

[58] Field of Search ..... 46/74 R, 74 D, 79, 76 R; 273/424, 425, 428; 102/92.4, 92.1, 92.6; 244/34 A, 16, 153 R; 220/8

[56] References Cited

U.S. PATENT DOCUMENTS

| | | | |
|---|---|---|---|
| 2,683,603 | 7/1954 | Gackenbach | 273/428 |
| 2,877,505 | 3/1959 | Stephens | 220/8 X |
| 3,264,776 | 8/1966 | Morrow | 46/74 R |
| 3,600,842 | 8/1971 | Bryman | 46/79 X |
| 3,982,489 | 9/1976 | Flatau et al. | 46/74 R X |
| 4,122,626 | 10/1978 | Waters | 46/79 X |
| 4,151,674 | 5/1979 | Klahn et al. | 46/74 D X |

*Primary Examiner*—Gene Mancene
*Assistant Examiner*—Mickey Yu
*Attorney, Agent, or Firm*—Arthur W. Fisher, III

[57] ABSTRACT

An aerial toy comprising a substantially annular hollow body having a thin wall intermediate portion including a leading and trailing edge formed on opposite ends thereof, a substantially annular recess formed on the outer surface of the thin wall intermediate portion adjacent the leading edge, a substantially annular ridge formed on the inner surface of the thin wall intermediate portion adjacent the leading edge and a weighting member comprising a substantially annular ring movable disposed within the thin wall intermediate portion such that aerial toy may be tossed or projected through the air by hand.

4 Claims, 4 Drawing Figures

FIG. 1
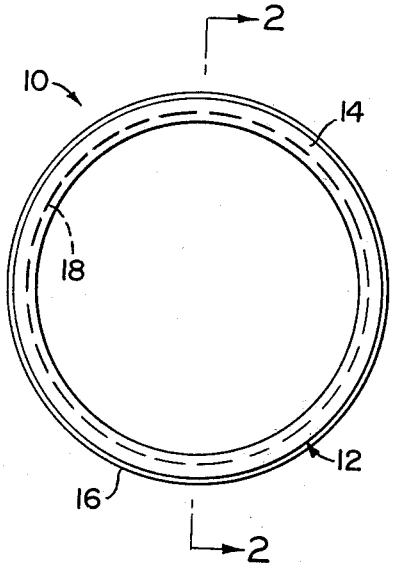
FIG. 2
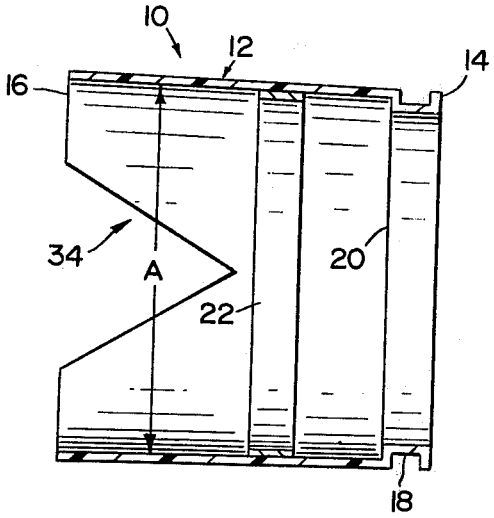
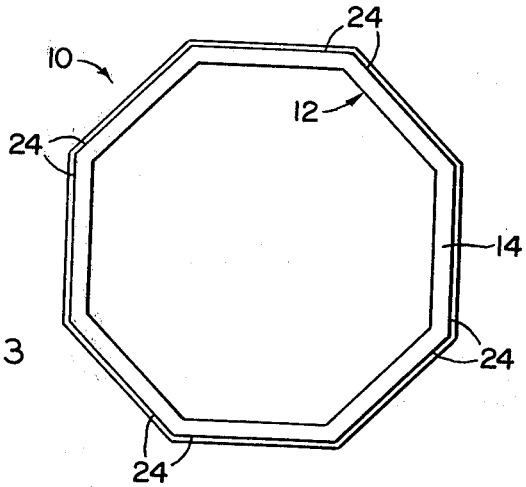
FIG. 3
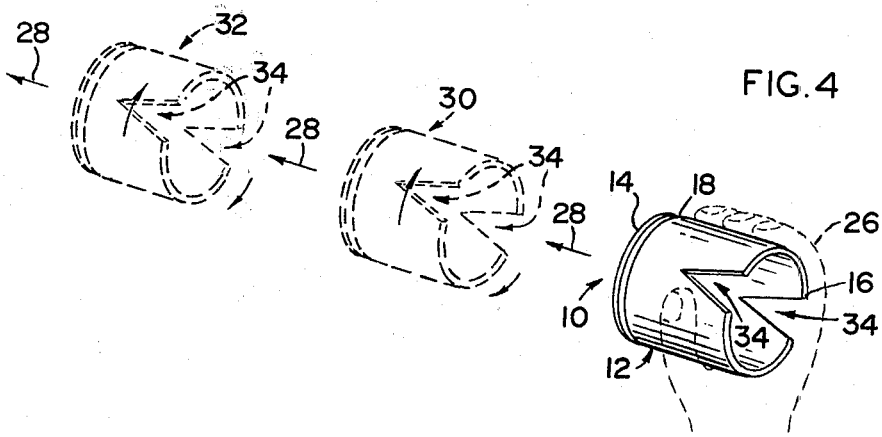
FIG. 4

AERIAL TOY

BACKGROUND OF THE INVENTION

1. Field of the Invention

An aerial toy configured to be tossed or thrown through the air.

2. Description of the Prior Art

The kite and the boomerang are early examples of flying or sailing toys. Other examples of such toys are glider airplanes and other operator propelled devices displaying aerodynamic properties. Examples of such aerial toys are described in U.S. Pat. Nos. 2,683,603; 2,690,339 and 2,822,176.

Another example of such devices similar to that of the present invention is disclosed in U.S. Pat. No. 3,264,776. U.S. Pat. No. 3,264,776 discloses an aerodynamic toy comprising a straight, hollow and longitudinally balanced tube, open at both ends having a leading and a trailing end. The tube is adapted to be propelled with a rotational motion about its longitudinal axis so that the tube flies in a direction generally along its axis of rotation. The tube is provided with weighted area adjacent to the leading end such that the center of gravity of the tube is located closer to the leading end than to the trailing end. Weighting in this fashion produced the longitudinal unbalance referred to above and it is this aspect of the device which is believed to result in a tube which exhibits airfoil characteristics.

Other prior art examples are shown in U.S. Pat. Nos. 3,099,450; 3,416,800; 3,566,532; 3,571,811; 3,852,910; and 4,086,723.

SUMMARY OF THE INVENTION

The present invention relates to an aerial toy configured to be thrown or tossed by hand to exhibit various flight or airfoil characteristics dependent, in part, by the manner of throwing.

The aerial toy comprises an annular or cylindrical hollow body having an intermediate portion including a leading and trailing ege formed on opposite ends thereof. An annular recess if formed on the outer surface of the intermediate portion adjacent the leading edge. A substantially annular ridge formed on the inner surface of the intermediate portion adjacent the leading edge 14, extends inwardly toward the center of the hollow body.

A weighting member comprising a substantially annular ring is movably fitted to the inner surface of the intermediate portion. The movable substantially annular ring permits the operator to selectively move the center of gravity to vary aerodynamic characteristics to produce long and stable flights resulting when the aerial toy is propelled by the user with a rotational motion about the longitudinal axis.

The use of the aerial toy is grasped with the fingers and thrown or launched. In addition to the forward motion, a spiral or rotational motion about the longitudinal axis may be imparted to spin the aerial toy about its axis. The aerial toy may be caused to dip or rise or curve while in flight by varying the position of the weighting members and user throwing techniques.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a front end view of the aerial toy.

FIG. 2 is a cross-section side view of the aerial toy taken along line 2—2 of FIG. 1.

FIG. 3 is a perspective view of an alternative embodiment of the trailing edge of the aerial toy.

FIG. 4 is an illustration of the aerial toy in flight.

Similar reference characters refer to similar parts throughout the several views of the drawings.

DETAILED DESCRIPTION OF THE PREFERRED EMBODIMENT

As shown in FIGS. 1 and 2, the present invention relates to an aerial toy generally indicated as 10 specifically configured to be thrown or tossed by hand to exhibit various flight or airfoil characteristics dependent, in part, by the manner of throwing.

The aerial toy 10 comprises a substantially annular hollow body having a thin wall intermediate portion 12 including a leading and trailing edge indicated as 14 and 16 respectively formed on opposite ends thereof. An annular recess 18 is formed on the outer surface of the thin wall intermediate portion 12 immediately adjacent the leading edge 14. A substantially annular ridge 20, formed on the inner surface of the thin wall intermediate portion 12 immediately adjacent the leading edge 14, extends inwardly toward the center of the hollow body. As best shown in FIG. 2, the cross sectional diameter A of the hollow body increases rearwardly from the leading edge 14 to the trailing edge 16 to produce an increased taper while the wall thickness of the hollow body remains substantially constance.

A weighting member comprising a substantially annular ring 22 is movably fitted to the inner surface of the thin wall intermediate portion 12. The movable substantially annular ring 22 permits the operator to selectively move the center of gravity to vary aerodynamic characteristics to produce long and stable flights resulting when the aerial toy 10 is propelled by the user with a rotational motion about the longitudinal axis.

FIG. 3 shows an alternate embodiment of the aerial toy 10. More specifically, the thin wall intermediate portion 12 comprises an irregular shape or configuration including a plurality of sides or elements 24 (preferably even numbered sides) disposed symmetrically relative to the longitudinal axis of aerial toy 10. By providing this alteration to the basic configuration of the aerial toy different flight characteristics can be imparted to it.

A plurality of cut out portions or notches 34 may be evenly spaced apart the periphery of the trailing edge 16 to increase flight path stability. The notches 34 are less than half the overall length of intermediate portion 12 which is preferably greater than two inches.

The use of the aerial toy 10 is shown in FIG. 4. The aerial toy 10 is grasped with the fingers 26 and thrown or launched forward in a direction indicated generally as 28. In addition to the forward motion, a spiral or rotational motion about the longitudinal axis may be imparted to spin the aerial toy 10 about the axis as shown at 30 and 32. The aerial toy 10 may be caused to dip or rise or curve while in flight by varying the weighting members 22 and user throwing techniques.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. An aerial toy comprising a hollow substantially cylindrical body having a thin wall intermediate portion including a leading and trailing edge formed on opposite ends thereof, a recess formed on the outer surface of said thin wall intermediate portion adjacent said leading edge such that said aerial toy may be tossed to project said aerial toy through the air by hand, said thin wall intermediate portion includes a plurality of notches formed in said trailing edge, said plurality of notches extend less than half the length of said thin wall intermediate portion, a weighting substantially annular member comprising a ring movably disposed within said thin wall intermediate portion to permit the operator to selectively move the center of gravity of said aerial toy to vary the aero-dynamic characteristics thereof.

2. The aerial toy of claim 1 wherein said recess comprises a substantially annular configuration formed on the outer surface of said thin wall intermediate portion.

3. The aerial toy of claim 1 further including a substantially annular ridge formed on the inner surface of said thin wall intermediate portion adjacent said leading edge.

4. The aerial toy of claim 1 wherein said plurality of notches comprises an even number of equally spaced notches.

* * * * *